United States Patent [19]

Yates, Jr.

[11] 4,293,073

[45] Oct. 6, 1981

[54] CONTAINER WITH COLLAR

[75] Inventor: George Yates, Jr., Glendale, Calif.

[73] Assignee: Growth International Industries Corp., Cleveland, Ohio

[21] Appl. No.: 807,862

[22] Filed: Jun. 20, 1977

Related U.S. Application Data

[63] Continuation of Ser. No. 649,712, Jan. 16, 1976, abandoned.

[51] Int. Cl.[3] ..... B65D 21/02

[52] U.S. Cl. ..... 206/519; 220/74; 220/91

[58] Field of Search ..... 206/519, 520; 220/72, 220/74, 91

[56] References Cited

U.S. PATENT DOCUMENTS

| | | | |
|---|---|---|---|
| 3,425,471 | 2/1969 | Yates | 220/91 |
| 3,516,571 | 6/1970 | Roper | 220/72 |
| 3,529,743 | 9/1970 | Ehtbar | 206/519 |
| 3,804,289 | 4/1974 | Churan | 220/72 |
| 3,908,855 | 9/1975 | Rowe | 220/91 |
| 3,915,363 | 10/1975 | Frankenberg | 220/91 |

FOREIGN PATENT DOCUMENTS

| | | | |
|---|---|---|---|
| 1218315 | 12/1959 | France | 220/519 |

*Primary Examiner*—George E. Lowrance

*Attorney, Agent, or Firm*—Squire, Sanders & Dempsey

[57] ABSTRACT

A simple, smooth, strong yet light weight plastic container having an open top end and a tapered sidewall with only an annular integral collar positioned near the top end and to which a bail is connected. The collar is of a lesser dimension that a closure to cover the top end and the plastic is semi-rigid.

5 Claims, 11 Drawing Figures

FIG. 1
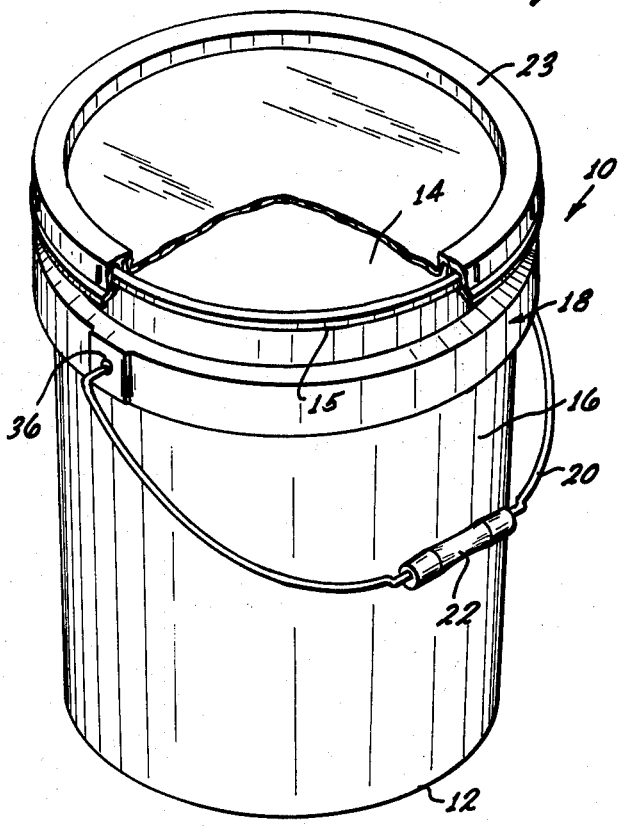
FIG. 2
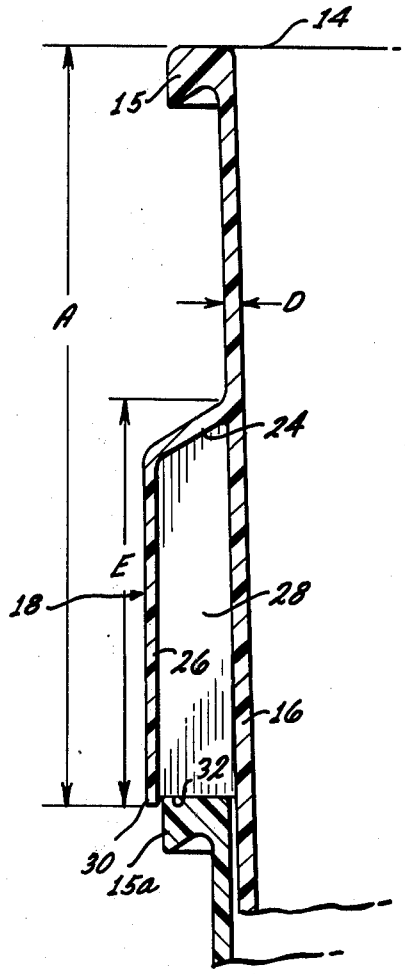
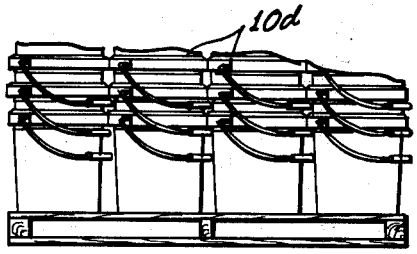
FIG. 8
FIG. 4
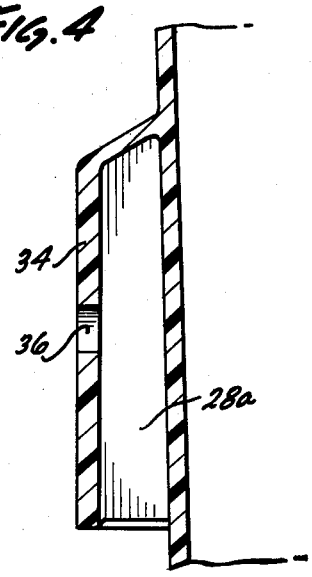
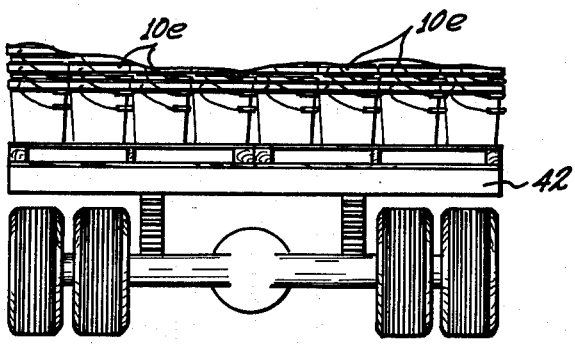
FIG. 9

CONTAINER WITH COLLAR

This is a continuation, of application Ser. No. 649,712, filed Jan. 16, 1976, now abandoned.

BACKGROUND OF THE INVENTION

1. Field of the Invention

The present invention relates to a shipping container and, more particularly, to a shipping container of molded synthetic resin material having many advantages, including high strength but low weight.

2. Description of the Prior Art

Within the last several years, nesting-type synthetic resin containers in sizes between one and seven gallons have become increasingly popular as a vehicle for transporting a variety of different products both liquid and solid. The use of plastic as a shipping container has many advantages over metal and paper containers such as light weight, durability and corrosion resistance.

Over the years a number of patents have issued on various aspects of plastic containers as well as on the closures that are used with such containers. Nevertheless, improvements have constantly been sought in order to provide an even more superior container.

SUMMARY OF THE INVENTION

The present invention improves upon those containers in the prior art in a number of important ways by providing a container comprised of a lower end; an open upper end; and a tapered sidewall being uninterrupted except for an annular integral collar of substantially constant height disposed about the sidewall, the collar including a vertical section generally parallel to the longitudinal axis of the container and an oblique section disposed between the sidewall and the vertical section.

A general aim of the present invention is to provide a superior shipping container.

Another aim of the present invention is to provide a container with improved shipping, stacking, nesting and strength characteristics.

Another important aspect of the present invention is to provide a container which is ovalization resistant and yet low in weight.

Other objects of the present invention include providing a container with a dust sealing feature when in a nested condition, a minimized nesting height, a smooth shape and an asthetically or cosmetically pleasing appearance.

Still other aspects of the present invention are to provide a container of relatively low manufacturing cost, which minimizes the use of material thereby conserving resources while at the same time achieving a container of easily attained quality.

A further aim of the present invention is to provide a container having a simplified bail, a collar portion smaller in diameter than the diameter of the container's lid or closure and a reduced stacking profile.

Other objects, aims, aspects and advantages of the invention will appear from the following description taken in conjunction with the accompanying drawings.

BRIEF DESCRIPTION OF THE DRAWINGS

FIG. 1 is an isometric view partially broken away of a container and closure;

FIG. 2 is an enlarged sectional elevational view of the collar and upper portion of the container taken along line 2—2 of FIG. 7;

FIG. 4 is an enlarged sectional elevational view of an ear embodiment taken along line 4—4 of FIG. 5;

FIG. 8 is an elevational view of four container stacks on a standard pallet measuring four feet by four feet;

FIG. 9 is an elevational view of eight stacks of containers aligned across the width of a flatbed trailer.

DESCRIPTION OF THE PREFERRED EMBODIMENTS

Figure 3:
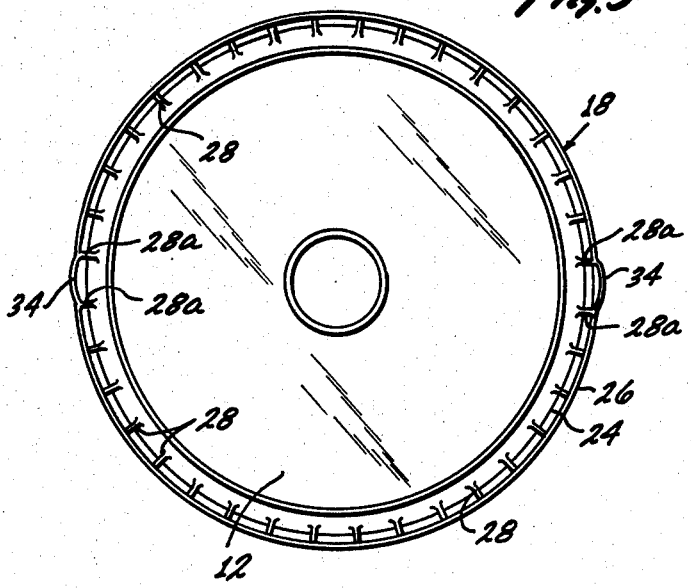
FIG. 3 is a bottom plan view of the container illustrated in FIG. 1.

While the present invention is susceptible to modifications and alternative constructions, illustrative embodiments are shown in the drawings and will be described in detail hereinbelow. It should be understood, however, that it is not the intention to limit the invention to the particular forms disclosed; but on the contrary, the intention is to cover all modifications, equivalences and alternative constructions falling within the spirit and scope of the invention as expressed in the appended claims.

Referring now to FIG. 1 there is illustrated a container 10 having a bottom or lower end 12 and an upper or top end 14 which is defined by a peripheral rim in the form of a bead 15. Between the bottom end and the top end is a tapered sidewall 16 which is uninterrupted except for an annular integral collar 18. Attached to the collar 18 is a bail 20 having a handle 22. A closure 23 seals the container.

The container 10 is preferably formed of a suitable semi-rigid plastic having sufficient strength to withstand the abuses to which a shipping container is subjected in normal use. Linear, high density polyethylene, polypropylene or copolymers thereof are especially suitable plastic materials although other polyolefins may be employed. Especially preferred plastics are polyethylene, polypropylene or copolymers having a stiffness ranging between 100,000 and 225,000 psi as measured by standard ASTM methods.

Referring now to FIGS. 2 and 3, the collar is described in more detail. As can be seen, the collar 18 is of substantially constant height and is comprised of two sections, an oblique section 24 and an integral upright section 26 which is generally vertical; that is, generally parallel to the longitudinal axis of the container. (The longitudinal axis would be parallel to a vertical line in the view of FIG. 2.). Located within the space defined by the oblique and vertical sections and the tapered sidewall 16 are a series of ribs 28. The lower end 30 of the vertical section 26 is spaced from the sidewall 16 and has an inner diameter about the same as the outer diameter of the bead 15. The lower end 32 of the ribs 28 are located at an elevation slightly above that of the lower end 30 of the vertical section 26. As will be explained hereinbelow, the resulting structure will allow a peripheral bead 15*a* of another container to be received by the collar such as shown in FIG. 2 whereby a sealing effect is achieved.

Figure 5:
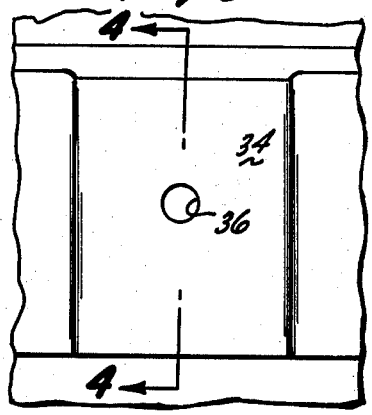
FIG. 5 is an elevational view of the ear embodiment shown in FIG. 4.
Figure 6:
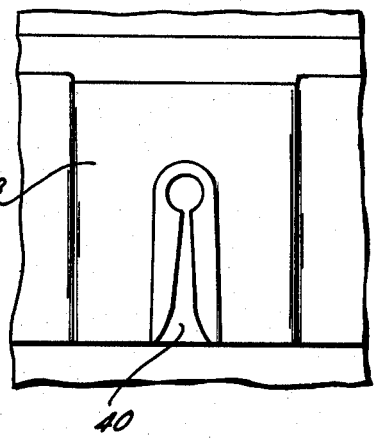
FIG. 6 is an elevational view of another ear embodiment.

Referring now to FIGS. 4, 5 and 6, there are illustrated variations of an ear structure for the attachment of the bail 20, FIG. 1, to the collar. For example, in FIGS. 4 and 5 the collar is reinforced by the Provision of a slightly greater thickness on the vertical section corresponding to section 26 in FIG. 2 to form an ear section 34 through which a opening 36 extends. The ribs 28*a* (FIG. 3) to each side of the ear section 34 may be radially disposed about the closure. It is to be understood that the ear sections are formed at the same time as the remainder of the container. The FIGS. 4 and 5 ear structure allows the receipt of a standard bail. It should be noted that the standard bail requires the ends thereof (not shown) to be bent in a compound angle in order to be inserted into the ear and to function properly in its "up", pail carrying or "down", at rest, positions.

Figure 6A:
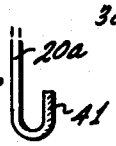
FIG. 6*a* is an elevational view of a portion of a bail for use with the FIG. 6 ear embodiment.

The FIG. 6 ear structure also includes a reinforced section 38 of slightly thicker dimension with a keyhole shaped opening 40. The keyhole shaped opening has the advantage of allowing a different bail 20*a*, FIG. 6*a* with a simple looped end 41 to be inserted. The advantage of this construction is that the bail can be simplified and thus made in a less expensive manner while the operation of attaching the bail to the container may also be done in a simplified manner. Presently there is a need to attach the bail manually due to the need to move the bail ends through the two directions dictated by the compound angle. However, if the FIG. 6*a* bail geometry is used, then a simple one directional movement of the bail relative to the container is required. This latter movement of course may be easily accomplished by machine.

Figure 7:
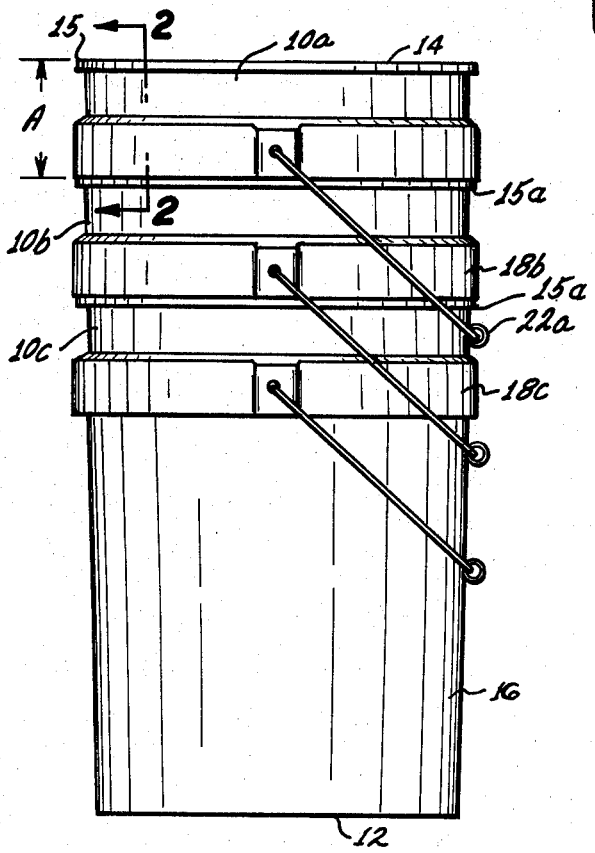
FIG. 7 is an elevational view of three nested containers.

An important advantage of the present invention is the minimization of nesting height of the container. Nesting is defined as the ability to store one container within another thereby reducing the total space occupied by unfilled containers. For example, in FIG. 7 there is illustrated three nested containers, container 10*a* nested within container 10*b* which in turn is nested within container 10*c*. In the five gallon container size the, nesting height is only 3¼ inches, the latter measurement being designated "A" in FIGS. 2 and 7 and representing improvement of more than 7% over any presently known five gallon container. Of course the smaller the nesting height, the greater will be the number of containers in a stack of a given height. Thus there will be a lesser need for storage and transportation space to handle unfilled containers.

It is also to be noted that the bail handle 22*a* of container 10*a* is positioned so as to rest beneath the collar 18*b* of the adjacent container 10*b* and above the collar 18*c* of the next adjacent container 10*c*. Thus the handle does not interfere with an adjacent stack during shipping as is common with existing containers.

Another important aspect of the present invention is the optimization of the lateral dimensions of the container. For example, there is illustrated in FIG. 8 four aligned stacks of nested containers 10*d* positioned on a standard four-foot wooden pallet. In FIG. 9, eight rows of nested containers 10*e* are shown aligned on a standard flatbed trailer 42 as they would appear when being transported from the container manufacturer to the product manufacturer who will fill the containers with its product. The widest dimension of the container is the collar diameter which for the five gallon size is only 12 inches (within usual manufacturing tolerances and not including the dimension from ear to ear which of course will be slightly greater than 12 inches).

In order to appreciate the advantage achieved by reducing the maximum diameter of the five gallon container to 12 inches, it is necessary to understand that most flatbed trucks and trailers are constructed to a standard eight foot width. It is also necessary to understand that freight charges are based upon the weight limitation of the standard trailer. Since plastic containers are volume limited rather than weight limited, making the containers more compact maximizes the space used and thereby reduces freight costs on a per container basis. As will be explained in more detail below the container of the present invention achieves a more compact design (for the same volume capacity) while having increased strength.

It is also to be noted that unlike some prior art containers, the collar of the present invention is of a smaller diameter than the maximum diameter of the closure. The closure may absorb some sidewise forces from adjacent objects with some deformation of the closure. This limited deformation enhances the locking engagement of the closure on the container. When the adjacent object exerts sufficient force to bear against the collar of the container, there is strong resistance against further deformation of either the container or the closure, and further deformation of the closure which could result in the disengagement of the latter does not occur.

As mentioned earlier, nesting the containers will also effect a seal of all containers except the upper-most due to the receipt of the rim 15*a*, FIG. 2, by the collar of the container immediately above. This sealing effect will help keep the interiors of the containers clean during shipment from the container manufacturer to the product manufacturer and during storage by the product manufacturer. Costs are reduced by eliminating in most circumstances the need of cleaning the interior of a container prior to it being filled with a product. This same structure also allows a high stable stack since each container is supported along a 360° arc. In the prior art only the ears supported the containers.

As mentioned the sidewall 16 is tapered and is shown smooth. The taper allows easy nesting and separation while the smooth design is less susceptible to dust and dirt deposits.

Another major aspect of the present invention is the strength of the container. A major concern of container users is ellipticity, more commonly referred to as the ovalization of the container when it is lifted by its handle. Ovalization is the lateral distortion of a circular container (when seen in plan view) caused by the inwardly directed horizontal components of the force on the handle reaching to the weight of the contents in the container. For example, in one test of five gallon containers having wall thicknesses of about 0.070 inches, the container designed as disclosed herein had a deflection of 0.665 inches while a prior art container had a deflection of 1.580 inches, more than twice as great. This reduction in ovalization is achieved with only an 8.3% increase in weight, from 724 grams to 786 grams while at the same time reducing the diameter of the container at its widest location.

Another major problem is ovalization during filling. The containers are usually placed on a conveyer for the filling cycle. At the end of the cycle, lids 23 are placed upon the containers and locking engagement is achieved by machine. If the containers do not retain their roundness on the conveyor then the lids which inherently retain their roundness cannot engage the container bead 15 and closure is not achieved. This disrupts the filling cycle and usually results in costly manual engagement of the lids and containers. If the filling product is in a heated condition as is often the case then the ovalization problem is exaggerated. Like all plastics, the semi-rigid plastic preferred herein softens when heat is applied. Therefore strength is reduced and ovalization is more likely. However, the construction of the elongated collar and the small ribs with large surface areas provide excellent heat radiation so that the collar is kept cool and therefore strong. Hence, even if the filling product is heated, the containers disclosed herein retain their roundness far better than comparable prior art containers.

A minimization of material used per container is also a major advantage of the present invention. For example, when using polyethylene the five gallon container just described weighs only about 786 grams, while the container shown, for example, in U.S. Pat. No. 3,804,289 weighs 963 grams; yet these containers are about equal in resistances to ovalization. Thus, there is a material savings of more than 18%.

Not only is the container compact and strong but also esthetically pleasing having a large uncluttered area beneath the collar. This uncluttered area is ideal for printed material or artwork which is frequently placed on such containers.

Figure 10:
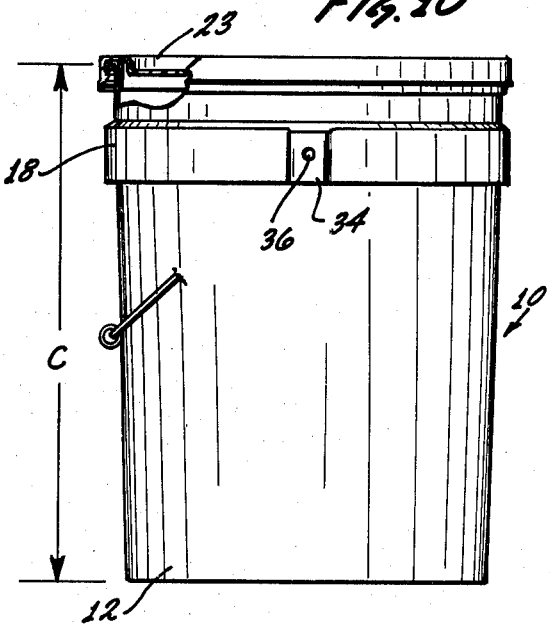
FIG. 10 is an elevational view partially broken away of the container and closure shown in FIG. 1.

While examples have been given with regard to five gallon containers, it is to be understood that other size containers are also within the purview of the invention. Such other sizes include 1, 2, 3½ and 6 gallons as well as the metric sizes inbetween. The full dimensions of the five gallon container are as follows: height is about 14¼ inches, the measurement designated "C" in FIG. 10, wall thickness is about 0.070 inches, the measurement designated "D" in FIG. 2, collar height is about 3⅜ inches, the measurement designated "E" in FIG. 2. For a 3½ gallon container: height is about 10⅜ inches, wall thickness is about 0.070 inches, and collar height is about 1½ inches. For a two gallon container: height is about 9⅜ inches, wall thickness is about 0.060 inches, and collar height is about 1 inch. For a 1 gallon container: height is about 7 3/16 inches, wall thickness is about 0.060 inches, and collar height is about 1⅛ inches. Calculations indicate that the height of container to the height of the collar falls within the range from 4 to 1 to 9½ to 1. Rib width varied between about 0.060 for the 3½ and 5 gallon containers to about 0.050 for the 1 and 2 gallon containers.

Thus what is achieved is an esthetically pleasing, relatively low cost yet strong and rugged container.

What is claimed is:

1. A container comprising:

a side wall in the shape of a tapered cylinder including an open upper end and a lower closed end smaller than said upper end, said upper end terminating in an outwardly extending bead having an outer surface; and an annular integral collar extending outwardly around said sidewall, said annular collar comprising a downwardly extending first section including an upper end and a free lower end, and a second section interconnecting the upper end of said first section and said side wall; said collar at the free end of said first section being spaced outwardly of said sidewall by a distance substantially equal to the outward extension of the bead; and a plurality of radial ribs interconnecting said first section of said collar and said sidewall, said ribs terminating in coplanar free ends spaced from the free lower end of said collar and disposed within said collar; said collar having an inner surface facing said side wall and extending below the coplanar free ends of said ribs, said inner surface having a configuration corresponding to the outer surface of said bead; said container being configured to nest with another like container, wherein the upper end of one container is received within the collar of the other container in abutting relationship with the free ends of said radial ribs and said inner surface of said collar is in sealing engagement with the outer surface of said bead.

2. A container according to claim 1, and constructed of semi-rigid plastic as a unitary body.

3. A container according to claim 1 wherein said collar further includes thickened integral ear portions on opposite sides of said collar for reinforcing the collar in said ear portions for receiving the end portions of a bail for carrying the container.

4. A container according to claim 3 wherein said reinforced portions each have a keyhole configuration for receiving a looped end of a bail.

5. A container of molded semi-rigid synthetic resin comprising:

a lower end;

an open upper end which terminates in a peripheral rim;

a tapered sidewall with an annular integral collar of substantially constant height disposed about said sidewall, said collar including a vertical section generally parallel to the longitudinal axis of said container and an oblique section disposed between said sidewall and said vertical section;

a generally circular closure for covering said open end, said closure having a peripheral portion engageable with the outer portion of said peripheral rim and an outer diameter greater than the outer diameter of said collar, whereby initial contact on said container by an adjacent similar container tends to urge said peripheral portion of said closure against said peripheral rim without distorting said collar.

* * * * *